United States Patent [19]

Guerra

[11] Patent Number: 4,708,272

[45] Date of Patent: Nov. 24, 1987

[54] APPARATUS AND METHOD FOR INSERTING A FOOT INTO A BOOT

[76] Inventor: Romeo E. Guerra, 6118 Walnut La., Dallas, Tex. 75243

[21] Appl. No.: 859,378

[22] Filed: May 5, 1986

[51] Int. Cl.[4] ..... A43B 11/00

[52] U.S. Cl. ..... 223/113; 36/10; 36/138; 2/239

[58] Field of Search ..... 36/1, 1.5, 10, 96, 97, 36/138; 2/239; 223/113, 111; 128/132 D, 157

[56] References Cited

U.S. PATENT DOCUMENTS

| | | | |
|---|---|---|---|
| 1,730,894 | 10/1929 | Marshall | 223/113 |
| 2,465,911 | 3/1949 | Morgan | 36/10 |
| 3,000,118 | 3/1960 | O'Shea | 36/10 |
| 3,117,385 | 11/1962 | Evans | 36/1 |
| 3,417,408 | 12/1968 | Caggiano | 36/10 |
| 3,694,940 | 10/1972 | Stohr . | |
| 3,762,075 | 7/1972 | Munschy | 36/2.5 |
| 4,021,941 | 5/1977 | Caggiano | 36/10 |
| 4,153,054 | 5/1979 | Boone | 223/111 X |
| 4,204,345 | 12/1977 | Bradley | 36/97 |

*Primary Examiner*—Andrew M. Falik
*Attorney, Agent, or Firm*—James E. Bradley

[57] ABSTRACT

A plastic film sleeve is used to facilitate inserting a foot into a boot. The sleeve has an open top to receive the foot and an open bottom from which the toes protrude. After insertion of the foot into the sleeve, the foot is inserted into the boot. When the foot reaches the instep and upper edge of the heel section of the boot, further downward pressure causes the sleeve to tear along a perforated line extending along the rearward side of the sleeve. When the foot is fully into the boot, the sleeve is pulled apart at the tear line at the top and pulled from the boot and discarded.

8 Claims, 6 Drawing Figures

APPARATUS AND METHOD FOR INSERTING A FOOT INTO A BOOT

BACKGROUND OF THE INVENTION

1. Field of the Invention:

This invention relates in general to footwear, and in particular to an apparatus and method to help one put boots on.

2. Description of the Prior Art:

Putting on slip-on boots has long been a problem. These type of boots do not have any ties or elastic to widen the opening between the instep and the heel while inserting the foot. Also, these type of boots, particularly cowboy boots, often have a long narrow barrel or upper section, making it even more difficult for the user to insert his foot into the boot.

The problem is most acute while the boots are new. The boots have to be fairly tight while new, otherwise when broken in, they will be too loose. Typically, a customer in a boot store will try on a number of pairs of boots before making his purchase. Each time, the customer will have to exert considerable force to get his foot into the boot. This can be uncomfortable and embarrassing. Also, on occasion, the user pulls too hard, pulling loose the ears or pull straps at the top of the upper section, damaging the stitching. It may not be possible to repair the boots back to the new condition again. Also, it is not uncommon for a women wearing hose to tear the hose with her toenails because of extensive force required.

Applicant knows of no device used to ease insertion of a foot into a boot. On occasion, some boot stores will spray a silicone spray into the boot to reduce friction in the heel and instep area.

SUMMARY OF THE INVENTION

A disposable plastic sleeve is used with this invention to facilitate putting a boot on. The sleeve has an open top for inserting the foot, and preferably an open bottom through which the toes protrude. The sleeve also has a curved heel section into which the user's heel slides when the sleeve is fully pulled onto the foot. Also, the sleeve has a tear line extending from the top to the bottom.

The user puts the sleeve on his foot, then inserts the sleeve-enclosed foot into the boot. Once the user's foot reaches the point where his heel and instep are entering the lower section of the boot, the sleeve will bind. The user continues to insert the foot. The tear line will tear out on the lower portion, and the foot will slide fully into the boot, with the sleeve remaining at the heel and instep area.

The user then grips the upper edges of the sleeve and pulls in opposite directions along the tear line. He pulls upwardly on the sleeve while the foot remains in the boot, tearing the sleeve apart and removing it from the boot.

DESCRIPTION OF THE PREFERRED EMBODIMENT

Figure 1:
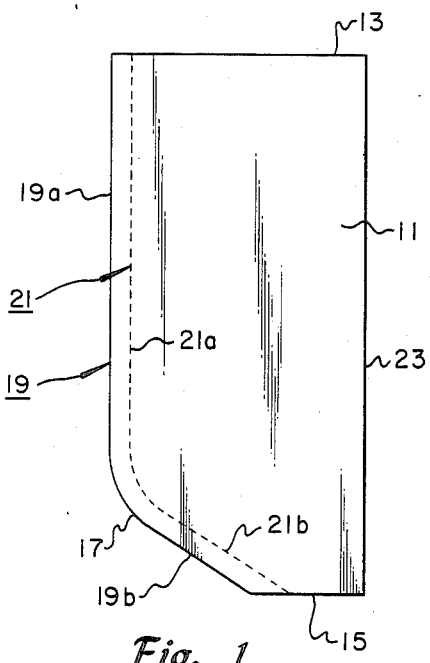
FIG. 1 is a side elevational view of a sleeve constructed in accordance with this invention.
Figure 2:
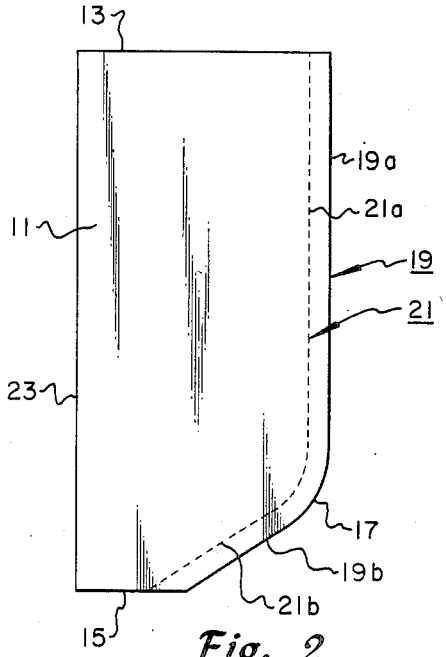
FIG. 2 is a side elevational view of the sleeve of FIG. 1, shown from the opposite side.

Referring to FIG. 1, sleeve 11 is formed of a thin film of a plastic material, such as polyethylene. The polyethylene film is flexible and smooth and generally will not stretch. Sleeve 11 is tubular, having an open top 13. the sleeve has an open bottom 15 which is of a lesser diameter than and parallel to the top 13. A heel section 17 is located on the lower portion along the rearward side of the sleeve 11. Heel section 17 has a straight lower portion that intersects the bottom opening 15 at an obtuse angle. Heel section 17 is thus inclined relative to the open top 13. Heel section 17 has a curved portion joining the lower portion and joining on its upper termination a vertical rearward side of the sleeve 11.

A seam 19 forms the rearward side of sleeve 11 and the contour of heel section 17. Seam 19 has an upper portion **19*a* extending upwardly from the curved part of heel section 17 that is vertical or perpendicular to the edges of the top and bottom 13 and 15. Seam 19 has a lower portion 19*b* extending downwardly from the curved part of heel section 17 that intersects the edge of bottom 15 at an obtuse angle of about 135 degrees with respect to the bottom 15. Seam 19 curves at the curved part of heel section 17. Seam 19** is formed by heat sealing a folded over sheet of the plastic material.

Two perforated lines 21, one on each side of the seam 19, are formed in the sleeve 11. Each line 21 is spaced a short distance from the seam 19, and is parallel to all portions of seam 19. Each line 21 has an upper portion **21*a* that is parallel with the upper portion 19*a* of seam 19. There is also a lower portion 21*b* of the perforated line that is parallel with the lower portion 19*b* of the seam 19. The perforated line portion 21*b* extends at an obtuse angle of about 135 degrees to the portion 21*a*. The intersection of the perforated line portion 21*b* with the line portion 21*a* is curved, following the curved part of heel section 17**.

The forward side of the sleeve 11, opposite the seam 19, is a straight vertical or longitudinal fold line 23. Sleeve 11 is formed of a sheet of plastic folded at fold line 23 and heat sealed at the seam 19. The perforating apparatus (not shown) extends through both sides of the sleeve 11 after it is folded, forming the two perforated lines 21. Prior to use, the sleeve 11 will be flattened, with its sides together, similar to plastic sacks used for lawn care or garbage purposes. Also, similar to plastic sacks, the sleeve 11 is preferably dispensed from a roll.

Figure 3:
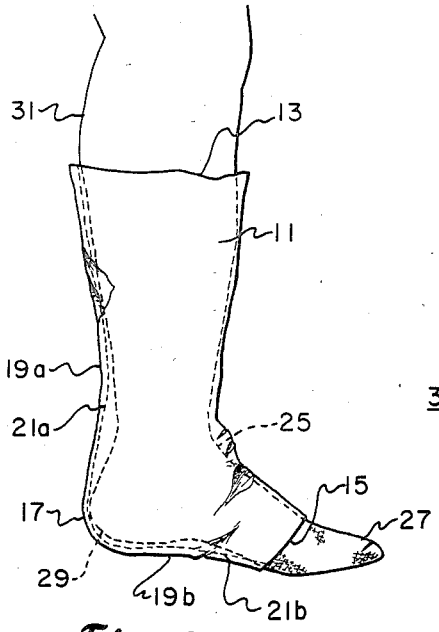
FIG. 3 is a side view of the sleeve of FIG. 1, shown with the foot inserted, and prior to inserting the foot into the boot.

In operation, as shown in FIG. 3, the first step is for the user to open the top opening 13 of the sleeve 11, and insert his foot into the opening 13. He will be wearing socks, or if a woman, possibly hosiery. The sleeve 11 fits over the socks or hosiery. He continues moving his foot downward until the toes 27 protrude through the open bottom 15. The user's heel 29 will locate in the heel section 17. The seam 19 will extend from the bottom of the user's foot 25 at the opening 15, rearwardly around the heel 29 and up to the upper edge 13 of the sleeve 11. The perforated line 21 will also be located partially on the bottom of the user's foot 25. Line 21 extends rearwardly around the heel 29 and up to the top 13 of sleeve 11. The top 13 will be located adjacent the calf 31 of the user. Because the fold line 23 is straight, the forward side of the sleeve will wrinkle at the instep of the foot 25.

Figure 4:
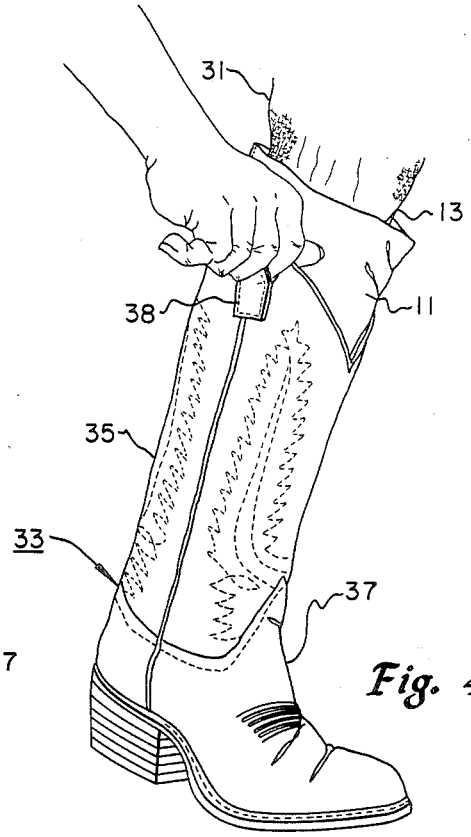
FIG. 4 is a perspective view of the sleeve, showing the user inserting the sleeve-enclosed foot into the boot.
Figure 5:
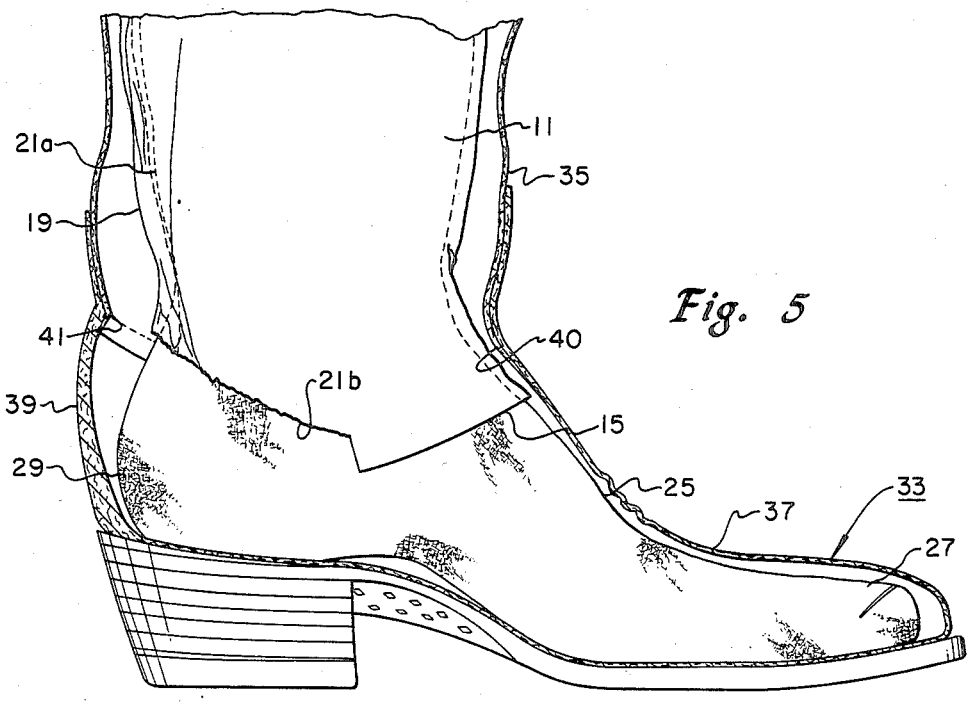
FIG. 5 is an enlarged cross-sectional view of part of a boot, showing the foot fully inserted into the boot, and the sleeve prior to removing it from the boot.
Figure 6:
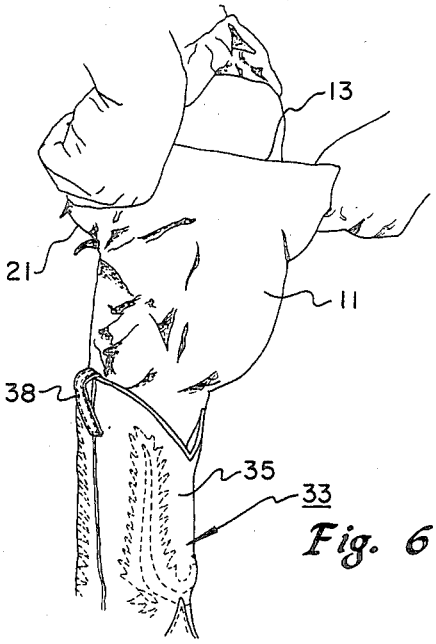
FIG. 6 is a partial perspective view of the sleeve, showing the removal of the sleeve from the boot.

Then, as shown in FIG. 4, the user inserts his foot 25, while sheathed by the sleeve 11, into the boot 33. Boot 33 will have an upper section or barrel 35 and a lower section 37. Also, normally the upper section 35 will have pull straps 38. Referring to FIG. 5, the boot will have a heel section 39 and an instep section 40. The heel section 39 terminates in a ridge 41, where the upper section 35 joins the heel section 39. The ridge 41 protrudes inwardly somewhat toward the instep section 40 on the opposite side.

As the user inserts the foot 25 into the boot 33, pressure will increase when the heel 29 contacts the ridge 41, and the instep of the foot 25 contacts the instep section 40. At this point, the sleeve 11 will bind and stop the downward movement. The user, using his pull straps 38, continues to push downward with his foot 25. The perforated line lower portion **21*b* will tear or separate as shown in FIG. 5, and the heel 29 will move downwardly to the full insertion point in the boot. The toes 27 will move forwardly from the open bottom 15 of sleeve 11. The sleeve 11 will remain stationary as the foot 25 tears the perforated lower portion 21*b*** and moves to this final position.

Once the foot 25 is fully inserted into the boot 33 as shown in FIG. 5, the user then grasps the sleeve 11 near the top 13 and pulls upwardly and outwardly in opposite directions. By pulling outwardly, the perforated line upper portion **21*a* will tear. As he pulls upwardly, the line portion 21*a* will tear downwardly to the previously torn lower portion 21*b*, allowing the sleeve 11 to be removed from calf 31 and discarded. When line 21 is fully separated, sleeve 11** will no longer be tubular.

The smooth film of sleeve 11 provides a low coefficient of friction against the sock or hose, allowing the foot 25 to easily slide downwardly relative to the sleeve 11. The sleeve 11 shields contact of the foot 25 with the instep 40 and heel ridge 41, to provide a smooth insertion into the boot 33. The instep portion 40 and the heel ridge 41, being normally of leather, would have a much greater coefficient of friction than the smooth polyethylene film of sleeve 11.

The invention has significant advantages. The sleeve greatly facilitates the insertion of foot into a tight boot. The sleeve is then discarded, providing no discomfort while wearing the boot. This sleeve will avoid tearing of pull straps, tearing of hose, and various embarrassments to customers purchasing new boots.

While the invention has been shown in only one of its forms, it should be apparent to those skilled in the art that it is not so limited, but is susceptible to various improvements without departing from the scope of the invention.

I claim:

1. An apparatus for facilitating insertion of a foot into a boot, comprising:

a sleeve formed of a thin, flexible material, having an open top for insertion of the foot into the sleeve, the sleeve reducing friction as the sleeve-enclosed foot is inserted into the boot;

the sleeve having tear line means extending along its length for causing the sleeve to tear apart longitudinally when the upper portion of the sleeve on opposite sides of the tear line means is pulled in opposite directions by the user, to pull the sleeve from the boot after the foot is inserted into the boot; and the sleeve being of smaller diameter at the bottom than at the top, and having a heel portion extending upwardly from the bottom at an inclined angle relative to the top for receiving the heel of the user.

2. An apparatus for facilitating insertion of a foot into a boot, comprising:

a sleeve formed of a thin, flexible material, having an open top for insertion of the foot into the sleeve, the sleeve reducing friction as the sleeve-enclosed foot is inserted into the boot;

the sleeve having tear line means extending along its length for causing the sleeve to tear apart longitudinally when the upper portion of the sleeve on opposite sides of the tear line means is pulled in opposite directions by the user, to pull the sleeve from the boot after the foot is inserted into the boot; and the sleeve being of smaller diameter at the bottom than at the top, and having a heel portion extending upwardly from the bottom at an inclined angle relative to the top for receiving the heel of the user; and the sleeve having an open bottom for the toes to pass through, the opening being smaller than the open top.

3. A disposable apparatus for facilitating insertion of a foot into a boot comprising:

a sleeve formed of a thin, flexible plastic material, the sleeve having an open top for receiving the foot, an open bottom through which toes of the foot protrude, and a heel section formed along a rearward side of the sleeve for receiving a heel of the foot, the open bottom being smaller in diameter than the open top; and the sleeve having tear line means extending along its length for causing the sleeve to tear apart longitudinally when the upper portion of the sleeve on opposite sides of the tear line means is pulled in opposite directions by the user, to pull the sleeve from the boot after the foot is inserted into the boot.

4. The apparatus according to claim 3 wherein the tear line means comprises at least one line of perforations extending along the rearward side of the sleeve from the top to the bottom.

5. A method of inserting a foot into a boot, comprising:

providing a sleeve of flexible material;

inserting the foot into the sleeve;

inserting the sleeve-enclosed foot into the boot; and pulling upwardly on the sleeve to remove the entire sleeve from the boot while the foot remains in the boot.

6. The method according to claim 5 further comprising the steps of:

providing a tear line along the length of the sleeve and pulling on opposite sides of the tear line at the top of the sleeve to remove the sleeve from the foot while the foot remains in the boot.

7. A method of inserting a foot into a boot, comprising:

providing a sleeve of a plastic film material, and providing the sleeve with an open top and a heel section adjacent a bottom;

providing a tear line along the sleeve from the bottom of the sleeve to the top;

inserting the foot into the sleeve until the heel locates in the heel section;

inserting the sleeve-enclosed foot into the boot; and when the heel section of the sleeve contacts the upper edge of a heel section of the boot, continuing to push downward with the foot, causing a lower portion of the tear line to separate and the foot to move downwardly into the boot while the sleeve remains stationary; then pulling on opposite sides of the tear line at the top of the sleeve and pulling upwardly on the sleeve while the foot remains stationary, to remove the sleeve from the boot and foot.

8. A method of inserting a foot into a boot, comprising:

providing a sleeve of a thin, smooth, flexible material, and providing the sleeve with an open top, an open bottom of smaller diameter than the open top, and a heel section extending from the open bottom at an inclined angle relative to the open top;

providing a tear line from the open bottom to the open top and extending along the heel section;

inserting the foot into the sleeve with toes of the foot protruding through the open bottom and with the heel of the foot located in the heel section;

inserting the sleeve-enclosed foot into the boot;

when the heel section of the sleeve contacts an upper edge of a heel section of the boot, continuing to push downward with the foot, causing a lower portion of the tear line to separate and the foot to move downwardly into the boot while the sleeve remains stationary; then pulling on opposite sides of the tear line at the top of the sleeve and pulling upwardly on the sleeve while the foot remains stationary, to remove the sleeve from the boot and foot.

* * * * *